United States Patent [19]

Saito

[11] 3,977,880

[45] Aug. 31, 1976

[54] DIRECT-POSITIVE EMULSION CONTAINING SILVER HALIDE GRAINS INTERNALLY DOPED WITH METAL IONS, SURFACE RIPENED WITH GOLD AND SULFUR COMPOUND AND FOGGED BY LIGHT EXPOSURE

[75] Inventor: Mitsuo Saito, Minami-ashigara, Japan

[73] Assignee: Fuji Photo Film Co., Ltd., Minami-ashigara, Japan

[22] Filed: Oct. 18, 1974

[21] Appl. No.: 515,958

[30] Foreign Application Priority Data

Oct. 18, 1973 Japan ..... 48-117289

[52] U.S. Cl. ..... 96/108; 96/107; 96/109; 96/139; 96/140

[51] Int. Cl.[2] ..... G03C 1/28

[58] Field of Search ..... 96/107, 108, 109, 139, 96/140

[56] References Cited

UNITED STATES PATENTS

| | | | |
|---|---|---|---|
| 1,574,944 | 10/1974 | Sheppard | 96/107 |
| 2,399,083 | 4/1946 | Waller et al. | 96/108 |
| 2,624,674 | 1/1953 | Tarkington et al. | 96/108 |
| 3,367,778 | 2/1968 | Berriman | 96/108 |
| 3,632,340 | 1/1972 | Illingsworth | 96/107 |
| 3,672,900 | 6/1972 | Kurz | 96/108 |

*Primary Examiner*—Won H. Louie, Jr.
*Attorney, Agent, or Firm*—Sughrue, Rothwell, Mion, Zinn and Macpeak

[57] ABSTRACT

A direct positive silver halide photographic emulsion comprising a hydrophilic colloid containing (1) silver halide grains the surface of which is fogged with a sulfur compound and a gold compound, or (2) silver halide grains which are (a) ripened with a sulfur compound and then the surface of which is fogged by optical exposure or (b) ripened with a sulfur compound and a gold compound and then the surface of which is fogged by optical exposure.

13 Claims, 3 Drawing Figures

DIRECT-POSITIVE EMULSION CONTAINING SILVER HALIDE GRAINS INTERNALLY DOPED WITH METAL IONS, SURFACE RIPENED WITH GOLD AND SULFUR COMPOUND AND FOGGED BY LIGHT EXPOSURE

BACKGROUND OF THE INVENTION

1. Field of the Invention

This invention relates to a direct positive silver halide photographic emulsion.

2. Description of the Prior Art

Direct positive silver halide photographic emulsions are described in, e.g., British Pat. No. 723,019, U.S. Pat. Nos. 3,501,305 and 3,632,340, and Japanese Patent Publication No. 1326/73. Such photographic emulsions comprise an emulsion obtained by adding a desensitizing dye which acts as an electron trap to an emulsion fogged with a reducing agent and a gold compound, or an emulsion in which the surface of silver halide grains having internal nuclei that accelerate the formation of silver by photolysis is fogged with a reducing agent and a gold compound.

When a direct positive silver halide photographic light-sensitive material having, on a support, a layer of a photographic emulsion prepared in this way is exposed and then developed, the resulting silver image has high contrast and it is very difficult to obtain an image of low contrast. Moreover, in an emulsion containing an electron trapping agent inside of the silver halide grains, reversal occurs initially due to the breakdown of fog nuclei, and then negative sensitivity occurs, thereby deteriorating the linearity of the H-D curve (the characteristic curve). The fog nuclei formed in the above way disappear with time and the fog density gradually decreases, so the emulsions can not be stored for a prolonged time.

Japanese Pat. Publication No. 4935/68 discloses usual emulsions in which iridium salt is used and the disclosure relates to a method of chemical sensitization of the surface of silver halide grains by adding an iridium salt during the emulsification or the ripening of the silver halide grains. However, an object of this emulsion is to prevent, when the emulsion is subjected to flash exposure, the usual formation of lower contrast as compared with the case of conventional exposure.

Moreover, Japanese Patent Publication No. 1326/73 discloses a direct positive silver halide photographic emulsion in which an iridium salt is used. This emulsion comprises an internal latent image type emulsion, and the surface of silver halide grains is subjected to sulfur sensitization.

SUMMARY OF THE INVENTION

Therefore, a first object of this invention is to provide a direct positive silver halide photographic emulsion which is stable and has excellent storage stability.

A second object of this invention is to provide a direct positive silver halide photographic emulsion in which fog levels can be readily established over a wide range and which is stable during the production thereof.

A third object of this invention is to provide a direct positive silver halide photographic emulsion producing a silver image with a soft gradation and having a wide exposure latitude.

A fourth object of this invention is to provide a direct positive silver halide photographic emulsion in which the H-D curve (characteristic curve) has good linearity.

A fifth object of this invention is to provide a direct positive silver halide photographic emulsion having higher reversal sensitivity.

The above objects are accomplished with a direct positive silver halide photographic emulsion according to this invention which comprises a hydrophilic colloid containing (1) silver halide grains whose surface is fogged with a compound containing a labile sulfur (hereinafter "sulfur compound") and a gold compound, or (2) silver halide grains which are (a) ripened with a sulfur compound and whose surface is fogged by optical exposure or (b) ripened with a sulfur compound and a gold compound and whose surface is fogged by optical exposure.

BRIEF DESCRIPTION OF THE DRAWINGS

In FIG. 1, F-1′ and F-2′ designate H-D curves of emulsions of this invention and H designates a H-D curve of a conventional emulsion.

DETAILED DESCRIPTION OF THE INVENTION

Figure 1:
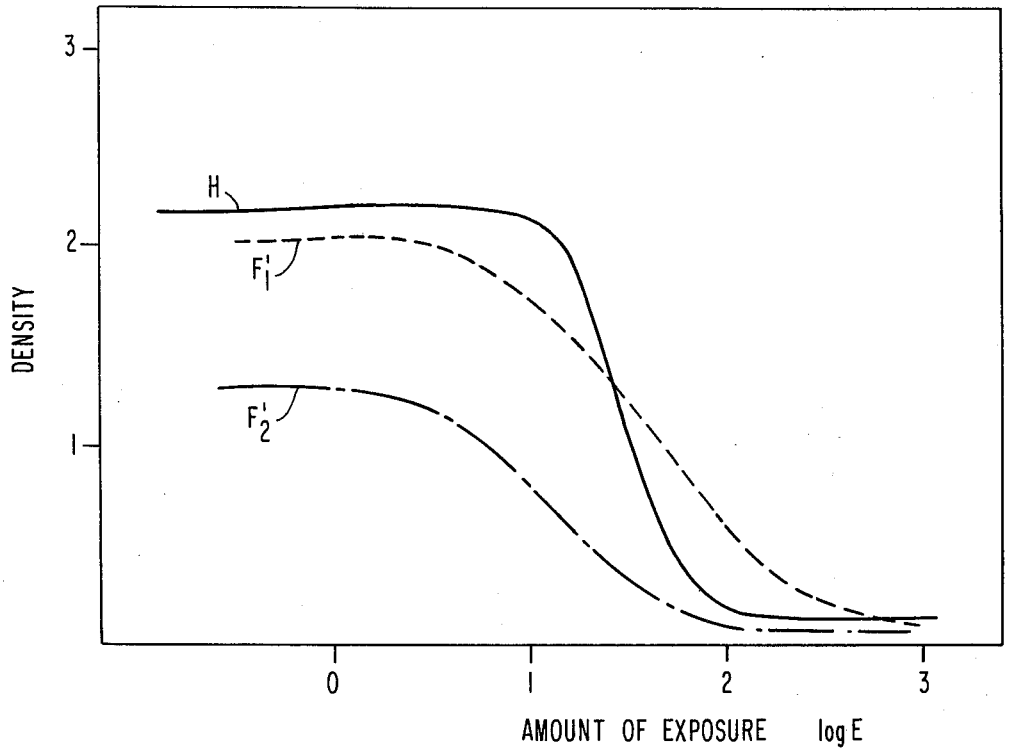
FIGS. 1 and 3 show H-D curves.

The method of ripening by the combined use of a gold compound and a sulfur compound is known, but the prior uses have been directed toward increasing the negative sensitivity of a photographic emulsion and have been employed in a lower fog region. This invention is novel in that it further increases fog and provides a direct reversal emulsion using fog nuclei.

In the emulsion of this invention, an electron trapping compound is incorporated in the interior of the silver halide grains. The amount of the electron trapping compound employed is generally about $10^{-8}$ to $10^{-2}$ mol, preferably, $10^{-6}$ to $10^{-4}$ mol, per mol of silver halide.

In the emulsion of this invention containing $10^{-8}$ to $10^{-2}$ mol of an electron trapping compound per mol of silver halide in the interior of the silver halide grains, it is particularly preferred that an organic sensitizing agent (halogen acceptor) whose potential at the anode in polarography is less than about 1.05 V and whose potential at the cathode is less than about 0.8 V is incorporated in the surface of silver halide grains, where objects of this invention can be accomplished, as well as the effect of providing higher reversal sensitivity is obtained.

The term "electron trapping compound" designates those compounds which produce a center causing the precipitation of photolyzed silver, that is, a center forming nuclei for the formation of a latent image, by treating physically or chemically using a conventional method, when the compound is added to the center of silver halide grains.

Such a center can be obtained by various methods as described in U.S. Pat. No. 3,367,778. A core portion of silver halide grains having a center for the formation of a latent image due to a metal of Group VIII of the periodic table such as palladium, iridium or platinum is particularly useful, since the center thereof is supposed to act simultaneously as an electron acceptor. As a technique of sensitizing such a core portion of silver halide grains, chemical techniques of the type as described in Antoine Hautot and Henri Saubeneir *Science et Industries Photographiques*, Vol. 28, pp. 1 to 23 and pp. 57 to 65, January, 1957, are particularly useful. Such chemical sensitization can be roughly classified into three groups, including a treatment of the silver halide with a gold or a noble metal sensitizing agent, a sulfur sensitizing agent such as an unstable sulfur compound, and a reduction sensitizing agent, for example, a strong reducing agent which introduces small metallic silver spots into the crystals of the silver halide or silver halide grains.

Electron trapping compounds which can be used in this invention are described in, for instance, U.S. Pat. No. 3,632,340. They are, for example, bismuth, noble metls or polyvalent metal salts such as ruthenium, rhodium, palladium, iridium, osmium or platinum and specifically include potassium hexachloroiridate (III), ammonium hexachloroiridate (IV), potassium hexachloropallate (IV), potassium hexachlororhodate (III), sodium hexachlororhodate (III), ammonium hexachloroosmate (IV), potassium hexachlororuthenate (IV), ammonium hexachlororuthenate (III), potassium hexachloroplatinate (IV), etc.

The electron trapping compound can be added at the beginning of the formation of the precipitates of silver halide. The electron trapping compound can be added, after the formation of grains, to the surface of the grains as a core portion of silver halide grains and silver halide is precipitated on the grains to prepare an original emulsion. The original emulsion is fogged at the surface of silver halide grains either through ripening with a sulfur compound and a gold compound as described below or through ripening with a sulfur compound or a sulfur compound and a gold compound followed by light irradiation.

The direct positive silver halide photographic emulsion of this invention comprising silver halide grains, whose surface is fogged with a sulfur compound and a gold compound, or silver halide grains which are ripened with a sulfur compound or a sulfur compound and a gold compound and whose surface is fogged by exposure is markedly different in terms of the condition of the silver halide grans present and the production thereof from a direct positive silver halide photographic emulsion comprising silver halide grains whose surface is fogged with a reducing agent and a gold compound as described in U.S. Pat. No. 3,501,305.

The purpose of using the reducing agent as described in U.S. Pat. No. 3,501,305 is for the formation of silver nuclei. When a gold compound is added after such a reduction ripening, the formation of fog is considerably promoted.

Moreover, the fogging effect according to this invention differs from that in the prior art as described above and, in addition, the compounds used therein are also different. That is, as reducing agents, thiourea dioxide, stannous chloride, hydrazines and phosphonium salts as described in U.S. Pat. Nos. 3,062,651 and 2,983,608, tin salts as described in U.S. Pat. No. 2,487,850 and polyamines as described in U.S. Pat. Nos. 2,519,698 and 2,521,925 are known.

On the other hand, the well known allylisothiourea, allylthiourea, allylisothiocyanate, phenylisothiocyante, phenylthiourea, sodium thiosulfate, thiocarbanilide, thiourea, thiosemicarbazide, thioacetamide, thioformamide, thiobarbituric acid, alkylthiocarbamate, cystine, p-toluenethiosulfonic acid salts and thiocyanates as described in U.S. Pat. Nos. 1,574,944, 1,623,499 and 2,410,689 can be used as the sulfur compound employed in this invention.

Gold salts which can be used in this invention are described in U.S. Pat. Nos. 2,642,361 and 2,399,083. For example, suitable gold salts include potassium dibromoaurate (I), potassium diiodoaurate (I), potassium tetraiodoaurate (III), potassium dichloroaurate (I), gold sulfate, sodium dichloroaurate (III), potassium tetrabromoaurate (III), sodium tetra-chloroaurate (III), potassium tetrachloroaurate (III), sodium dithiosulfatoaurate (I), potassium dithiosulfatoaurate (I), gold (III) chloride, sodium disulfitoaurate (I), thiourea - gold (III) chloride complex, 2-aurosulfobenzothiazole mesochloride, gold (III) chloride - 3-ethyl-5-[(3-ethyl)-2-(3H)-benzoxazolylideneethylidene]rhodanine adduct, etc.

The ripening according to this invention is preferably conducted using both a sulfur compound and a gold compound, but the direct positive silver halide photographic emulsion of this invention can also be obtained where sulfur ripening is effected and the surface of silver halide grains is then fogged by optical exposure, i.e., light irradiation. A suitable amount of exposure which can be used for this purpose is such that log E ranges from about −2 to +3 (where E is in CMS).

The amounts of the gold compound and the sulfur compound which are employed are, respectively, about $10^{-8}$ to $10^{-3}$ mol and about $10^{-8}$ to $10^{-2}$ mol per mol of silver halide. Where sulfur ripening and gold ripening are effected, $(AuS_2O_3)_2^{3-}$ as the goldsulfur ripening agent in an amount of about $10^{-8}$ to $10^{-3}$ mol is particularly preferred. Where only sulfur ripening is effected without gold ripening, the amount of the sulfur compound employed is suitably about $10^{-6}$ to $10^{-2}$ mol.

It is further preferred to form silver halide grains in the presence of a thiocyanate salt (such as potassium thiocyanate) or an acid (such as sulfuric acid or acetic acid) (which is particularly preferred to be added to an aqueous solution of gelatin), since a direct positive silver halide photographic emulsion with higher sensitivity is obtained.

Further, the emulsion of the present invention is capable of controling fog-density by adding reducing agents. Suitable reducing agents are disclosed in U.S. Pat. Nos. 2,983,608 and 3,062,651.

A group of preferred halogen acceptors used in practicing this invention is the optically sensitizing merocyanine dyes having the following general formula (I)

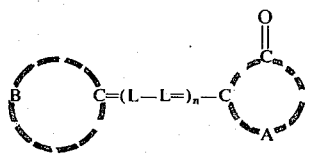

(I)

wherein, A represents the atoms required for completing an acidic heterocyclic ring such as a rhodanine ring or a 2-thiohydantoin ring; B represents the atoms required for completing a basic nitrogen-containing heterocyclic ring such as a benzothiazole ring, a naphthothiazole ring or a benzoxazole ring, L represents a methine group such as

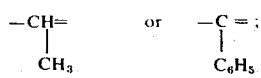

and $n$ is an integer of 0, 1 or 2.

Halogen-accepting merocyanine dyes used in practicing this invention are shown by the following general formula (II)

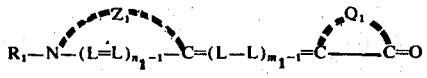

(II)

wherein $m_1$ is an integer of 1 to 3; $R_1$ represents an alkyl group (including a substituted alkyl group), preferably, those alkyl groups having 1 to 8 carbon atoms such as methyl, ethyl, propyl, butyl or octyl, a sulfoalkyl group such as sulfopropyl or sulfobutyl, a sulfatoalkyl group such as sulfatopropyl or sulfatobutyl, a carboxyalkyl group such as carboxyethyl or carboxybutyl, or an aryl group (including a substituted aryl group) such as phenyl, sulfophenyl, carboxyphenyl or tolyl; L represents a methine group (both unsubstituted or substituted); $n_1$ is a positive integer of 1 to 3; and $Z_1$ represents the non-metal atoms required for completing a 5- or 6-membered heterocyclic ring such a benzothiazole nucleus, a benzoxazole nucleus, a benzoselenazole nucleus, an $\alpha$-naphthothiazole nucleus, a $\beta$-naphthothiazole nucleus, an $\alpha$-naphthoxazole nucleus, a $\beta$-naphthoxazole nucleus, an $\alpha$-naphthoselenazole nucleus, a $\beta$-naphthoselenazole nucleus, a thiazoline nucleus, a simple thiazole nucleus (for example, 4-methylthiazole, 4-phenylthiazole or 4-(2-ethynyl)-thiazole), a simple selenazole nucleus (for example, 4-methylselenazole or 4-phenylselenazole), a simple oxazole nucleus (for example, 4-methyloxazole or 4-phenyloxazole), a quinoline nucleus, a pyridine nucleus or a 3,3-dialkylindolenine nucleus; $Q_1$ represents a 5-membered heterocyclic ring such as a rhodanine nucleus, a 2-thio-2,4(3,5)-oxazoledione nucleus, a 2-thiohydantoin nucleus or a 5-pyrazolone nucleus.

A preferred group of halogen-accepting compounds used in practicing this invention is represented by the following general formula (III)

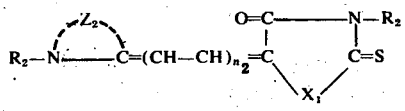

(III)

wherein, $R_2$ represents an alkyl group (including a substituted alkyl group), preferably, those alkyl groups having 1 to 8 atoms such as methyl, ethyl, propyl, butyl or octyl, an sulfoalkyl group such as sulfopropyl or sulfobutyl, a sulfatoalkyl group such as sulfatopropyl or sulfatobutyl, a carboxyalkyl group such as carboxyethyl or carboxybutyl, or an aryl group (including a substituted aryl group) such as phenyl, sulfophenyl, carboxyphenyl or tolyl; $n_2$ is a positive integer of 1 to 2; $Z_2$ represents the non-metal atoms required for completing a 5- or 6-membererd heterocyclic ring as defined in the general formula (I); and $X_1$ represents an oxygen, sulfur or selenium atom, or a

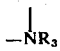

group wherein $R_3$ is preferably an alkyl group (including a substituted alkyl group) having 1 to 8 carbon atoms such as methyl, ethyl, propyl, butyl or octyl, a sulfoalkyl group such as sulfopropyl or sulfobutyl, a sulfatoalkyl group such as sulfatopropyl or sulfatobutyl, a carboxyalkyl group such as carboxyethyl or carboxybutyl, or an aryl group (including a substituted aryl group) such as phenyl, sulfophenyl, carboxyphenyl or tolyl). The production of dyes used in practicing this invention is described in U.S. Pat. Nos. 2,493,747 and 2,493,748.

Specific examples of halogen-accepting compounds which can be used in practicing this invention include 3-carboxymethyl-5-[(3-ethyl-2-benzothiazolinylidene)ethylidene]phrodanine, 3-ethyl-5-[(3-ethyl-2-benzothiazolinylidene)ethylidene]rhodanine, 3-(2dimethylaminoethyl)-5-[4-(3-ethyl-2-benzothiazolinylidene)-2-butenylidene]rhodanine, 3-ethyl-5-[(3-ethyl-2-benzoxazolinylidene)-ethylidene]rhodanine, 3-(2-dimethylaminoethyl)-5-[4-(3-ethyl-2-benzothiazolinylidene)-2-butenylidene]rhodanine, 3-ethyl-5-[(3-ethyl-2-benzoxazolinylidene)-ethylidene]rhodanine, 3-carboxymethyl-5-[(3-ethyl-2-benzoxazolinylidene)ethylidene]phodanine, 3-carboxymethyl-5-[(3-methyl-2-thiazolidinylidene)-1-methylethylidene]-rhodanine, 3-carboxymethyl-5-(3-ethyl-4-methyl-4-thiazolin-2-ylidene)rhodanine, 5-[(3-methyl-2-thiazolidinylidene)-1-methylethylidene]-3-(2-sulfoethyl)rhodanine, 3-ethyl-5-[1-(4-sulfobutyl)-4(1H)-pyridylidene]rhodanine sodium salt, 3-ethyl-5-(1-ethyl-4(1H)-pyridylidene)rhodanine, 3-ethyl-5-[(3-ethyl-2-benzothiazolinylidene)-ethylidene]-2-thio-2,4-oxazolidenedione, 3-carboxymethyl-5-[(3-ethyl-2-benzoxazolinylidene)ethylidene]-2-thio-2,4-oxazolidinedione, 3-ethyl-5-[3-ethylnaphtho[2,1-d]oxazolin-2-ylidene)-ethylidene]-2-thio-2,4-oxazolidinedione, 1-carboxymethyl-5-[(3-ethyl-2-benzothiazolinylidene)ethylidene]-3-phenyl-2-thiohydantoin, 1-carboxymethyl-5-[(3-ethyl-2-benzoxazolinylidene)ethylidene]-3-phenyl-2-thiohydantoin, 1-carboxymethyl-5-[(1-ethylnaphtho[1,2-d]-thiazolin-2-ylidene)ethylidene]-3-butenyl-2-thiohydantoin, 3-heptyl-5-(1-methylnaphtho[1,2-d]thiazolin-2-ylidene)-1-phenyl-2-thiohydantoin, 5-[4-(3-ethyl-2-benzoxazolinylidene)-2-butenylidene]-1,3-diphenyl-2-thiohydantoin, 4-[(1-ethyl-naphtho[1,2-d]thiazolin-2-ylidene)methylethylidene]-3-methyl-1-(4-sulfophenyl)-2-pyrazolin-5-one, 1-ethoxycarbonylmethyl-5-[(1,2-d]thiazolin-2-ylidene)ethylidene]-3-(4-nitrophenyl)-2-thiohydantoin, 5-[4-(3-ethyl-2-benzothiazolinylidene)-2-butenylidene]-3-heptyl-2-thio-2,4-oxazolidinedione, 5-[(1,3-diallylimidazo[4,5-b]quinoxalin-2(3H)-ylidene)ethylidene]-3-ethylrhodanine, 3-ethyl-5-(3-methyl-2-thiazolinylidene)ethylidene-2-thio-2,4-oxazolidinedione, 5-[(3-(2-carboxyethyl)-2-thiazolinylidene]ethylidene-3-ethylrhodanine, 5-[(3-methyl-2-thiazolidinylidene)-1-methyl-ethylidene]-3-(2morpholinoethyl)rhodanine, 5-[(3-(2-carboxy)-ethyl-2thiazolidinylidene)-1-methylethylidene]-3-carboxymethylrhodanine, 5-[(3-(2-carboxyethyl)-2-thiazolidinylidene)-1-methylethylidene]-3-carboxymethylrhodanine, 5-[(3-(2-carboxyethyl)-thiazolidinylidene)-1-methylethylidene]-3-(2-methoxyethyl)rhodanine and 3-(3-dimethylaminopropyl)-5-[(3-methyl-2-thiazolidinylidene)ethylidene]rhodanine. The halogen acceptor used in practicing this invention can be used in various concentrations over a wide range, but it is generally used in a concentration of about 2 mg to about 1.0 g, preferably about 10 to about 500 mg, per mol of silver halide.

The emulsion of this invention can further contain a dye as described in U.S pat. application Ser. No. 351,386, filed Apr. 16, 1973.

In the silver halide emulsion according to this invention, the surface of grains can be fogged on ripening with the combined use of the sulfur compound and the gold compound, or can be fogged by exposure after sulfur ripening or sulfur ripening and gold ripening.

On the other hand, as a usual way of fogging a silver halide emulsion, it is known to fog the surface of grains with a reducing agent and a gold compound as described in U.S. Pat. No. 3,501,305, or to fog with light of high illuminance.

The way of fogging according to this invention is novel in which the surface of grains is fogged through sulfur and gold ripening or fogged by the exposure after sulfur ripening or sulfur and gold ripening.

The composition of silver halide used in this invention can be a silver bromide, silver bromoiodide, silver chlorobromide, silver chlorobromoiodide, etc. The diameter of the silver halide grains is preferably about 0.1 to 2 $\mu$. The silver halide emulsion can contain monodispersed grains or polydispersed grains.

The shape of silver halide grains can be of the cubic form, octahedral form or clam form as described in U.S. pat. application Ser. No. 469,136, filed May 13, 1974 or the like. The emulsion of this invention is not affected by the shape of silver halide grains.

The direct positive silver halide emulsion of this invention can be blended with a direct positive silver halide photographic emulsion presently known as described in British Pat. No. 723,019, U.S. Pat. Nos. 3,501,305 and 3,632,340, and Japanese Pat. Publication No. 1326/73.

It is preferred to add a hydroxytetrazaindene compound represented by the following general formulas (IV) and (V) as described in Japanese Pat. Application No. 46398/73 to the emulsion of this invention, since the shelf stability is further improved:

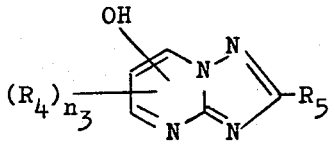

(IV)

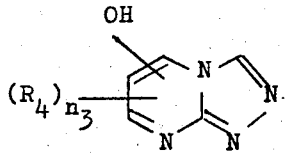

(V)

wherein, $R_4$ and $R_5$ each represents a hydrogen atom, an alkyl group (such as a methyl, ethyl, propyl or butyl group; or an alkyl group substituted with a hydroxy, carboxyl, alkoxy group, etc.), or an aryl group (such as a phenyl group; or a phenyl group substituted with an alkyl group, halogen atom, hydroxy group, etc.), and $n_3$ is 1 or 2.

Illustrative examples of the compounds represented by the general formulas (XI) and (XII) are 4-hydroxy-6-methyl-1,3,3a,7-tetrazaindene, 4-hydroxy-2,3,3a,7-tetrazaindene, 4-hydroxy-6-methyl-1,2,3a,7-tetrazaindene, 4-hydroxy-6-phenyl-1,3,3a,7-tetrazaindene and 4-methyl-6-hydroxy-1,3,3a,7-tetrazaindene.

A hydrophilic colloid is used as a binder for the emulsion of this invention and includes gelatin, colloidal albumin, casein, cellulose derivatives, synthetic hydrophilic colloids such as polyvinyl alcohol, poly-N-vinyl pyrrolidone, etc. If desired, a compatible mixture of two or more hydrophilic colloids can also be used.

Of the above described hydrophilic colloids, gelatin is most generally used, but gelatin can be, partially or completely, replaced with a so-called gelatin derivative, i.e., a derivative prepared by reacting the functional groups in the gelatin molecule such as amino, imino, hydroxy or carboxyl groups with a compound having a group capable of reacting with such a functional group, or a graft polymer prepared by grafting the molecular chain of another high molecular weight substance to the gelatin. Examples of compounds reacting with gelatin for producing the above-described gelatin derivatives are those as described in U.S. Pat. Nos. 2,614,928, 2,763,639, 3,118,766, 3,132,945, 3,312,553 and 3,328,257, and Japanese Pat. Publication No. 26845/72, as well as acid chlorides such as benzenesulfonyl chlorides or benzoyl chloride, acid anhydrides such as phthalic anhydride, acetic anhydride or succinic anhydride, bromoacetic acid, phenyl isocyanate, diethyl carbonate, N-phenylvinylsulfonamide, acrylonitrile and phenylglycidyl ether.

High molecular weight substances which can be used for grafting to gelatin are described in, e.g., U.S. Pat. Nos. 2,763,625, 2,831,767 and 2,956,884. Polymers or copolymers of acrylic acid, methacrylic acid, derivatives of acrylic acid and derivatives of methacrylic acid such as the esters, amides or nitriles thereof, and styrene can be used for this purpose. Particularly preferred polymers or copolymers are hydrophilic vinylic polymers which are somewhat compatible with gelatin, for example, polymers or copolymers of acrylamide, methacrylamide, hydroxyalkyl acrylate or hydroxyalkyl methacrylate.

The binder is preferably used in an amount ranging from about 10 to 150 g per mol of silver halide.

The direct positive silver halide photographic emulsion of this invention can be coated on a rigid support such as glass, metal or ceramic, or on a flexible support. Typical examples of flexible supports are those which are generally used for photographic elements, for example, cellulose nitrate films, cellulose acetate films, polyvinyl acetal films, polystyrene films, polyethylene terephthalate films, polycarbonate films, laminates of these films, thin glass films or papers. Satisfactory results can be also obtained with supports such as baryta paper, papers coated with a polymer of an $\alpha$-olefin having 2 to 10 carbon atoms such as polyethylene, polypropylene or an ethylene-butene copolymer, or plastic films having matted surfaces for improving the adhesivity with other high molecular weight substances and improving the printability as described in Japanese Pat. Publication No. 19068/72.

The direct positive silver halide photographic emulsion of this invention is suitably coated at a coverage of about 0.1 to 10 mg (as silver)/m$^2$ on a support.

The direct positive silver halide photographic emulsion of this invention has excellent storage stability.

Moreover, the direct positive silver halide emulsion of this invention has high sensitivity as compared with conventional direct positive silver halide emulsions, and an image can be obtained with various gradation, from a low contrast to high contrast, according to this invention.

Furthermore, the direct positive silver halide photographic emulsion of this invention can provide H-D curves with excellent linearity and various $\gamma$ values.

In addition, the fog density can be optionally adjusted for the direct positive silver halide photographic emulsion of this invention.

The direct positive silver halide photographic emulsion of this invention can be used for the production of a color photosensitive materials by subjecting to spectral sensitization in various ways and is also applicable for X-ray duplicating films, lith duplicating films, 8 mm color films, color papers and photosensitive materials for the silver-dye-bleach process. The emulsion of this invention can be also employed in photosensitive materials for the color diffusion transfer reversal process.

The emulsion of this invention can be used for other various purposes.

This invention is explained in greater detail by reference to the following examples. Unless otherwise indicated, all parts, percents, ratios and the like are by weight.

EXAMPLE 1

To an aqueous solution of gelatin containing ammonia (containing 500 cc of water, 4 cc of 25% aqueous ammonia and 30 g of gelatin), 750 cc of aqueous solution of potassium bromide (1 mol/liter) and 500 cc of aqueous solution of silver nitrate (1.2 mol/liter) were simultaneously added under stirring. The addition was affected in the following manner over a 50 minute period while keeping the pAg at 7.9 at 50°C. That is, 15 minutes after the starting, the addition of the aqueous solution of potassium bromide and the aqueous solution of silver nitrate was stopped and an aqueous solution of potassium hexachloroiridate (III) ($10^{-2}$ mol/liter) was added. After ripening for 30 minutes, the aqueous solution of potassium bromide and the aqueous solution of silver nitrate were again added over a 35 minute period. A 10% aqueous solution of Demol N (a condensate of sodium naphthalenesulfonate and formaldehyde) made by Kao Atlas CO., LtD. was added, and water washing was effected in such a manner as to precipitate a silver halide emulsion to provide an original emulsion.

Emulsions prepared using the above iridium compound in amounts of 0, $4 \times 10^{-6}$, $1.6 \times 10^{-5}$ and $6.4 \times 10^{-5}$ mol per mol of silver halide are respectively referred to herein as original Emulsions A, B, C and D. To each of these Emulsions A, B, C abd D, an aqueous solution of a gold compound having the following composition was added at one time in amounts of 0, $3.2 \times 10^{-6}$ and $1.3 \times 10^{-5}$ mol of $Au(So_2O_3)_2^{3-}$ per mol of the silver halide.

| | |
|---|---|
| $HAuCl_4.4H_2O$ (0.1%) | 1 cc |
| KCl (0.2 mol) | 0.5 cc |
| $Na_2SO_3$ (0.005 mol) | 0.5 cc |
| $Na_2S_2O_3$ (0.01 mol) | 0.5 cc |

The emulsions were stirred at 50°C for 60 minutes. The emulsions were repened and simultaneously fogged. They are respectively referred to as Emulsions A-1, A-2, A-3, B-1, B-2, B-3, C-1, C-2, C-3, D-1, D-2 and D-3.

These emulsions were coated at a coverage of 1.4 mg of silver per $cm^2$ on a cellulose triacetate film, cooled, set and dried. The coated products thus obtained were exposed for one second through a continuous wedge to a tungsten lamp of 1 Kw (color temperature of 2854°K) at a distance of 46.2 cm. Then, they were treated with a surface developer having the following composition at 20°C for 10 minutes, washed with water and dried.

| Surface Developer | |
|---|---|
| Water | 1,000 cc |
| N-Methyl-p-aminophenol Sulfate | 2.5 g |
| Ascorbic Acid | 10 g |
| Sodium Metaborate (tetrahydrate) | 35.0 g |
| Potassium Bromide | 1.0 g |

The photographic density of the films developed was measured using an automatic densitometer made by the Fuji Photo Film Co., Ltd. The results obtained are shown in Table 1.

Table 1

| Emulsion | Dmax (Fog Density) | Reversal Sensitivity | $\gamma$ | Iridium Compound (mol/mol of AgX) | $Au(S_2O_3)_2^{3-}$ (mol/mol of AgX) |
|---|---|---|---|---|---|
| A-1 | 0 | Not reversed | — | 0 | 0 |
| A-2 | 1.3 | Not reversed | — | 0 | $3.2 \times 10^{-6}$ |
| A-3 | 2.3 | Not reversed | — | 0 | $1.3 \times 10^{-5}$ |
| B-1 | 0.05 | Not reversed | — | $4 \times 10^{-6}$ | 0 |
| B-2 | 0.8 | 1.5 | 0.3 | $4 \times 10^{-6}$ | $3.2 \times 10^{-6}$ |
| B-3 | 1.0 | 1.6 | 0.3 | $4 \times 10^{-6}$ | $1.3 \times 10^{-5}$ |
| C-1 | 0.01 | Not reversed | — | $1.6 \times 10^{-5}$ | 0 |
| C-2 | 1.5 | 0.8 | 0.7 | $1.6 \times 10^{-5}$ | $3.2 \times 10^{-6}$ |
| C-3 | 0.5 | 2.2 | 0.2 | $1.6 \times 10^{-5}$ | $1.3 \times 10^{-5}$ |
| D-1 | 0.01 | Not reversed | — | $6.4 \times 10^{-5}$ | 0 |
| D-2 | 2.3 | 2.1 | 1.5 | $6.4 \times 10^{-5}$ | $3.2 \times 10^{-6}$ |
| D-3 | 3.1 | 2.1 | 1.9 | $6.4 \times 10^{-5}$ | $1.3 \times 10^{-5}$ |

Emulsions D-2 and D-3 had a negative image at the low exposed portions and a positive image at highly exposed portions, and the photographic properties at the positive portions are shown in the above table.

The reversal sensitivity is expressed by log E, wherein E represents the exposure amount required for providing a density 0.2 lower than the maximum density Dmax.

As is apparent from the results in Table 1, the direct positive silver halide photographic emulsion of this invention has high sensitivity, and the fog density and the $\gamma$ value can be varied depending upon the amounts of the iridium compound and the sulfur compound employed.

Moreover, when he ripening times for the above emulsions C-2 and C-3 were changed from 60 minutes to 90 minutes, the fog density was altered to 2.2 and 0.75, respectively. That is, the fog density can be adjusted by changing the ripening time.

When 3-carboxymethyl-5-[3-(3-methyl-(2)(3)-thiazolinylidene)-isopropylidene]rhodanine as a sensitizing agent was added to each of emulsions B-2, B-3, C-2, C-3, D-2 and D-3, the reversal sensitivity was further increased and, thus, preferred direct positive emulsions were prepared.

EXAMPLE 2

To the original Emulsion C prepared as described in Example 1, $6.4 \times 10^{-3}$ mol of hypo per mol of silver halide was added at a time, and the emulsion was ripened at 50°C for 60 minutes or 90 minutes. These emulsions are respectively referred to as Emulsions C-4 and C-5. These emulsions were coated on a support in the same manner as described in Example 1. After uniform exposure at log E = 1.5, they were exposed, developed and subjected to density measurement in the same manner as described in Example 1. The results obtained are shown in Table 2.

Table 2

| Emulsion | Dmax | Reversal Sensitivity | $\gamma$ |
|---|---|---|---|
| C-4 | 1.0 | 1.8 | 1.2 |
| C-5 | 1.8 | 2.0 | 1.7 |

It is apparent from the results in Table 2 that Dmax can be adjusted by changing the ripening time as in Example 1.

EXAMPLE 3

To an aqueous solution containing ammonia (containing 4 cc of 25% aqueous ammonia, 500 cc of water and 30 g of gelatin), 750 cc of an aqueous solution containing 90 g of potassium bromide and 3.6 g of potassium iodide and 500 cc of an aqueous solution containing 100 g of silver nitrate were simultaneously added under stirring. The addition was effected in the following manner over a 50 minute period while adjusting the pAg to 7.9 at 45°C.

That is, 15 minutes after starting, the addition of the aqueous solution of potassium bromide and the aqueous solution of silver nitrate was stopped, and an aqueous solution of ammonium hexachloroiridate (IV) ($10^{-2}$ mol/liter) was added. After ripening for 30 minutes, the aqueous solution of halide and the aqueous solution of silver nitrate were again added over a 35 minute period. A 10% aqueous solution of Demol N was added, and water washing was effected in such a manner as to precipitate a silver halide emulsion, which was set, thus providing an original emulsion.

The emulsions prepared using the iridium compound in amounts of $3.2 \times 10^{-6}$, $1.6 \times 10^{-5}$ and $6.4 \times 10^{-5}$ mol/mol of AgX are respectively referred to as original Emulsions E, F and G. To these original emulsions, $Au(S_2O_3)_2^{3-}$ was added at a time in the same manner as in Example 1 in amounts of $3.2 \times 10^{-6}$ and $1.3 \times 10^{-5}$ mol per mol of silver halide. The emulsions were stirred at 50°C for 60 minutes. The emulsions were ripened and simultaneously fogged. They are respectively referred to as Emulsions E-1, E-2, F-1, F-2, G-1 and G-2. These emulsions were coated, cooled to set, dried, exposed, developed and subjected to density measurement in the same manner as described in Example 1. The results obtained are shown in Table 3.

Table 3

| Emulsion | Dmax | Reversal Sensitivity | $\gamma$ | Iridium Compound (mol/mol of AgX) | $Au(S_2O_3)_2^{3-}$ (mol/mol of AgX) |
|---|---|---|---|---|---|
| E-1 | 3.8 | 1.8 | 3 | $3.2 \times 10^{-6}$ | $3.2 \times 10^{-6}$ |
| E-2 | More than 4.0 | About 1.6 | 4.5 | $3.2 \times 10^{-6}$ | $1.3 \times 10^{-5}$ |
| F-1 | 1.9 | 1.0 | 1.3 | $1.6 \times 10^{-5}$ | $3.2 \times 10^{-6}$ |
| F-2 | 1.4 | 1.0 | 1.2 | $1.6 \times 10^{-5}$ | $1.3 \times 10^{-5}$ |
| G-1 | 1.2 | 1.1 | 0.7 | $6.4 \times 10^{-5}$ | $3.2 \times 10^{-6}$ |
| G-2 | 1.5 | 1.2 | 0.6 | $6.4 \times 10^{-5}$ | $1.3 \times 10^{-5}$ |

The emulsions shown in Table 3 had a negative image at the low exposed portions and a positive image at highly exposed portions, and the photographic properties of the positive portions are shown in the above table.

The coated products of Emulsions F-1 and F-2 were subjected to uniform exposure at log E = 0.6 using a tungsten lamp (2854°K) and again exposed through a continuous wedge, and then developed, which are respectively referred to as F-1′ and F-2′.

The results obtained are shown in Table 4.

Table 4

| Emulsion | Dmax | Reversal Sensitivity | $\gamma$ |
|---|---|---|---|
| F-1′ | 2.1 | 0.7 | 1.3 |
| F-2′ | 1.35 | 0.6 | 1.0 |

The reversal sensitivities of emulsions F-1′ and F-2′ were increased as compared with those of the emulsions F-1 and F-2. That is, the sensitivity is improved due to the pre-exposure.

As is apparent from the above examples, the D max and $\gamma$ value of the emulsion of this invention can be varied over a wide range by changing the amounts of the gold compound and the sulfur compound and the ripening time.

The H-C curves of Emulsions F-1′ and F-2′ and a conventional direct positive emulsion are shown in FIG. 1.

A sample for comparison was prepared in the following manner.

To an aqueous solution of gelatin (containing 500 cc of water and 8 g of gelatin), 150 cc of an aqueous solution of silver nitrate (3.92 mol/liter) and 150 cc of an aqueous solution of potassium bromide (3.92 mol/liter) were simultaneously added while stirring at 60°C and at a pAg of 7.0. After 6 minutes, the addition was stopped, and an iridium salt, $K_3IrCl_6$, was added at one time in an amount of $10^{-4}$ mol per mol of silver nitrate based on the total silver nitrate added. After ripening for 2 minutes, the aqueous solution of silver nitrate and the aqueous solution of potassium bromide were again added under stirring over a 44 minute period to form grains. After washing with water in the same manner as described in Example 1, the grains were fogged through ripening with a reducing agent and a gold compound at 50°C for 30 minutes. Hydrazine chloride (17 mg/mol of AgX), as a reducing agent, and potassium chloroaurate (4.2 mg/mol of AgX), as a gold compound, were added at one time.

The emulsion thus obtained was coated, dried, exposed, developed and subjected to density measurement in the same manner as described in Example 1, which is referred to as Emulsion H.

As is seen from the comparison shown in FIG. 1, F-1′ and F-2′ provide high sensitivity and a low contrast as compared with Emulsion H.

EXAMPLE 4

In order to compare the storage stability of the coated products of the emulsions, samples were forcedly deteriorated by keeping a sample of Emulsion C-2 prepared as in Example 1 and a sample of Emulsion H under the condition of 50°C and a humidity of 80% for 3 days, which are respectively referred to as C-2′ and H′. The samples were exposed, subjected to surface development and then subjected to density measurement in the same manner as described in Example 1.

Figure 2:
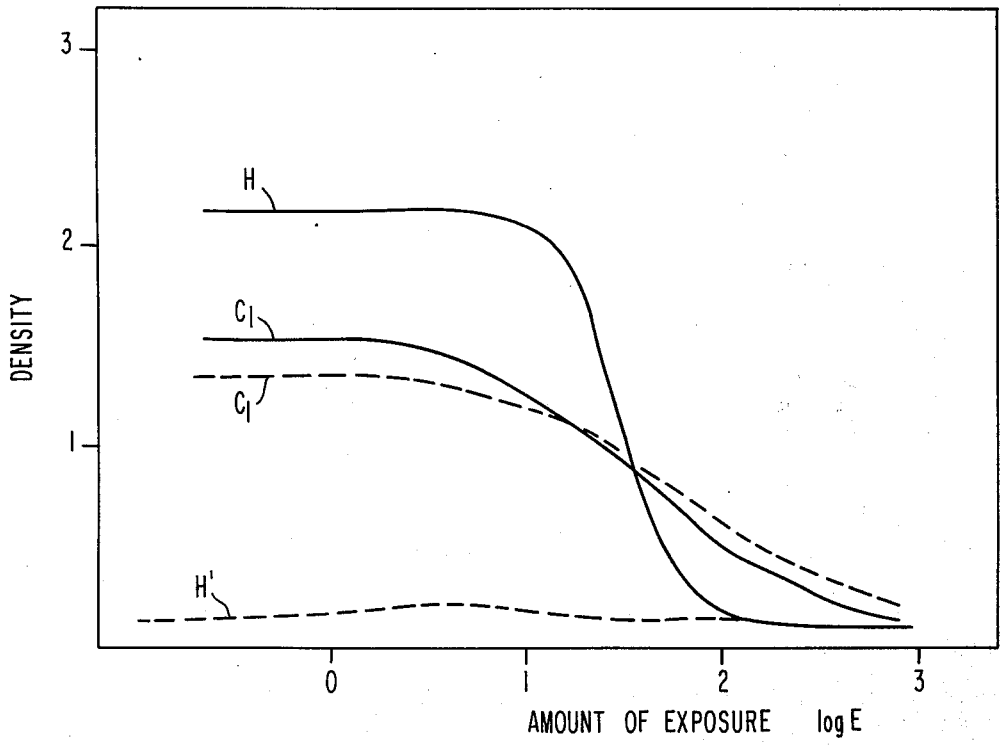
In FIG. 2, C-1 and C-1′ designate H-D curves of emulsions of this invention and H and H′ designate H-D curves of conventional emulsions. C-1 and H designate H-D curves immediately after the production of the emulsions, and C-1′ and H′ designate H-D curves after the storage.

It is clear from FIG. 2 that the coated product of the novel emulsion of this invention is very excellent in storage stability, while the coated product of the Emulsion H the surface of which is fogged with the reducing agent and the gold compound shows less shelf stability.

EXAMPLE 5

To an emulsion prepared in the same manner as described in Example 3 except for the amount of $(NH_4)_2IrCl_6$ of $1.72 \times 10^{-5}$ mol per mol of silver halide added and the amount of $Au(S_2O_3)_2^{3-}$ of $1.1 \times 10^{-5}$ mol/mol of silver halide added on ripening, (3-ethyl-2-benzothiazole) (1,2-dimethyl-3-pyrazolo[1,5-a]benzimidazole)-dimethylcyanine bromide was added at one time in an amount of 0, $4.4 \times 10^{-5}$ or $1.7 \times 10^{-4}$ mol per mol of silver halide. After stirring for one hour, the emulsions were coated in the same manner as described in Example 1, which are respectively referred to as Emulsions I-1, I-2 and I-3.

Figure 3:
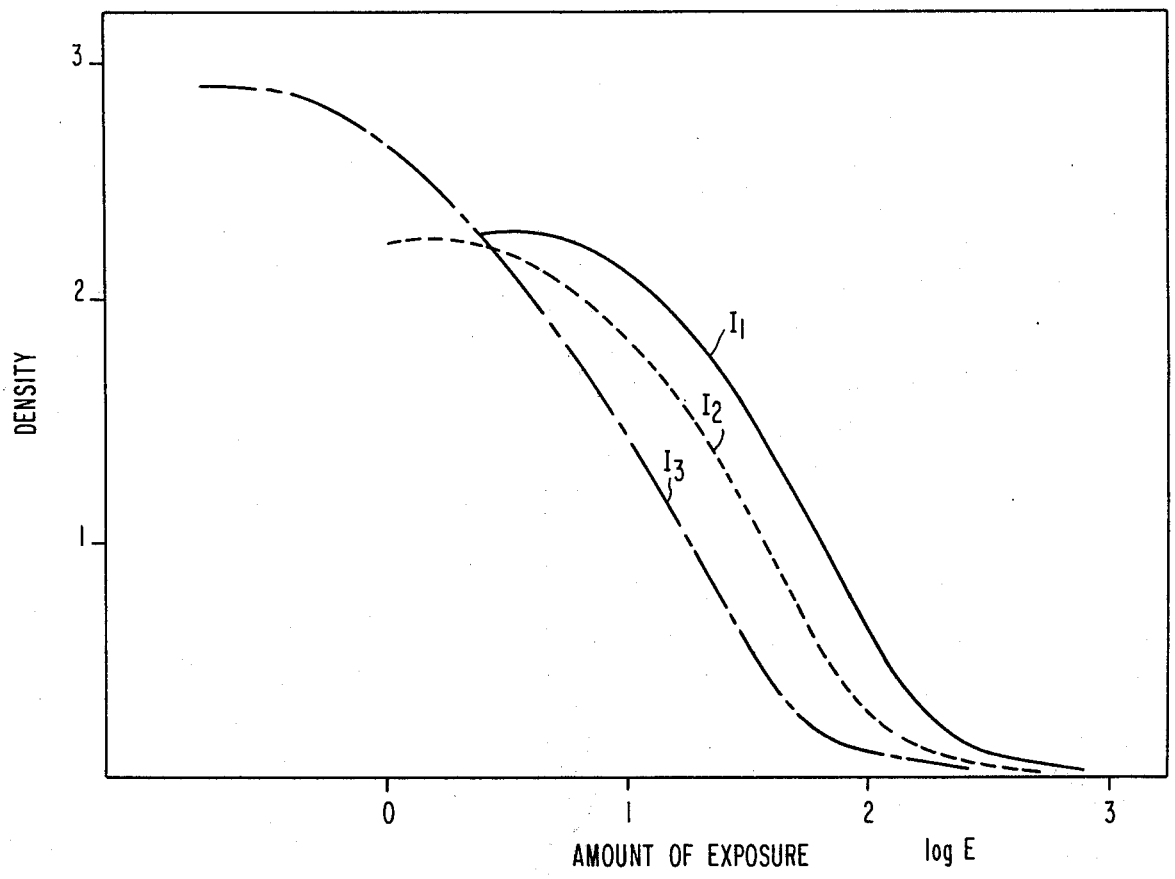

The emulsions were exposed, subjected to surface development and then subjected to density measurement in the same manner as described in Example 1. The results obtained are shown in FIG. 3. An increase of the reversal sensitivity is observed.

While the invention has been described in detail and with reference to specific embodiments thereof, it will be apparent to one skilled in the art that various changes and modifications can be made therein without departing from the spirit and scope thereof.

What is claimed is:

1. A direct positive silver halide photo-sensitive emulsion comprising a hydrophilic colloid containing silver halide grains the interior of which contain an electron trapping polyvalent metal salt and the surface of which are ripened with a compound containing a labile sulfur and a gold compound and then the surface of which is fogged by light exposure.

2. The direct positive silver halide photographic emulsion of claim 1, wherein the interior of said silver halide grains contains an electron trapping compound in an amount of about $10^{-}$to $10^{-2}$ mole per mole of silver halide.

3. The direct positive silver halide photographic emulsion of claim 2, wherein said electron trapping compound is potassium hexachloroiridate (III), ammonium hexachloroiridate (III), potassium hexachloroiridate (IV), ammonium hexachloroiridate (IV), potassium hexachlororhodate (III) or sodium hexachlororhodate (III).

4. The direct positive silver halide photographic emulsion of claim 1, wherein said gold compound and said compound containing a labile sulfur is $K_3Au(S_2O_3)_2$ or $Na_3Au(S_2O_3)_2$.

5. The direct positive silver halide photographic emulsion of claim 4, wherein said $K_3Au(S_2O_3)_2$ or $Na_3Au(S_2O_3)_2$ is present in an amount of $10^{-8}$ to $10^{-3}$ moles per mole of silver halide.

6. The direct positive silver halide photographic emulsion of claim 1, wherein said compound containing a labile sulfur is allylisothiourea, allylthiourea, allylisothiocyanate, phenylisothiocyanate, phenylthiourea, sodium thiosulfate, thiocarbanilide, thiourea, thiosemicarbazide, thioacetamide, thioformamide, thiobarbituric acid, alkylthiocarbamate, cystine, a p-toluenethio-sulfonic acid salt, a thiocyanate or a mixture thereof and wherein said gold compound is potassium dibromoaurate (I), potassium diiodoaurate (I), potassium tetraiodoaurate (III), potassium dichloroaurate (I), gold sulfate, sodium dichloroaurate (III), potassium tetrabromoaurate (III), sodium tetrachloroaurate (III), potassium tetrachloroaurate (I), gold (III) chloride, sodium disulfitoaurate (I), thiourea - gold (III) chloride complex, 2-aurosulfobenzothiazole mesochloride, gold (III) chloride-3-ethyl-5-[(3-ethyl)-2-(3H)-benzoxazolylidene-ethylidene]rhodanine adduct or a mixture thereof.

7. The direct positive silver halide photographic emulsion of claim 1, wherein said light exposure is in an amount such that log E ranges from −2 to +3, wherein E is an exposure amount in CMS.

8. The direct positive silver halide photographic emulsion of claim 1, wherein said emulsion contains a halogen-accepting compount selected from the compounds represented by the general formula (I),

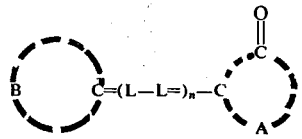

(I)

wherein, A represents the atoms required for completing an acidic heterocyclic ring, B represents the atoms required for completing a basic nitrogen-containing heterocyclic ring, L represents a methine group and n is an integer of 0, 1 or 2; general formula (II)

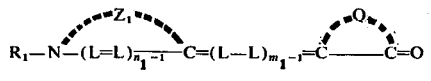

(II)

wherein, $m_1$ is an integer of 1 to 3, $R_1$ represents an alkyl group or an aryl group, L represents a methine group, $n_1$ is a positive integer of 1 to 3, $Z_1$ represents the non-metal atoms required for completing a 5- or 6-membered heterocyclic ring and $Q_1$ represents a 5-membered heterocyclic ring; or general formula (III)

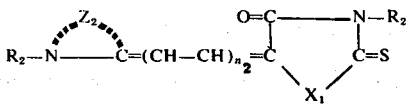

(III)

wherein, $R_2$ represents an alkyl group or an aryl group, $n_2$ is a positive integer of 1 or 2, $Z_2$ represents the non-metal atoms required for completing a 5- or 6- membered heterocyclic ring and $X_1$ represents an oxygen, sulfur or selenium atom or a

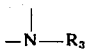

group wherein $R_3$ is an alkyl group or an aryl group.

9. The direct positive silver halide photographic emulsion of claim 8, wherein in general formula (I), A represents a rhodamine ring or a 2-thiohydantoin ring and B represents a benzothiazole ring, naphthothiazole ring or a benzoxazole ring; in the general formula (II), $R_1$ represents an alkyl group having 1 to 8 carbon atoms, phenyl group, sulfophenyl group, carboxyphenyl group or tolyl group; said ring of $Z_1$ is a benzothiazole nucleus, a benzoxazole nucleus, a benzoselenazole nucleus, an $\alpha$-naphthothiazole nucleus, a $\beta$-naphthothiazole nucleus, an $\alpha$-naphthoxazole nucleus, a $\beta$-naphthoxazole nucleus, an $\alpha$-naphthoselenazole nucleus, a $\beta$-naphthoselenazole nucleus, a thiazoline nucleus, 4-methylthiazole 4-phenylthiazole, 4-(2-ethynyl)-thiazole, 4-methylselenazole, 4-phenylselenazole, 4-methyloxazole, 4-phenyloxazole, a quinoline nucleus, a pyridine nucleus or a 3,3-dialkylindolenine nucleus; said ring of Q is a rhodanine nucleus, a 2-thio-2,4(3,5)-oxazoledione nucleus, a thiohydantoin nucleus or 5-pyrazolone nucleus; and in the general formula (III) $R_2$ represents an alkyl group having 1 to 8 carbon atoms, phenyl group, sulfophenyl group, carboxyphenyl group or tolyl group, said ring of $Z_2$ represents the same ring of $Z_1$ in the general formula (I) and $R_3$ represents an alkyl group having 1 to 8 carbon atoms, phenyl group, sulfophenyl group, carboxyphenyl group or tolyl group.

10. The direct positive silver halide photographic emulsion of claim 8, wherein the amount of said halogen-accepting compound is present in an amount of about 2 mg to about 1.0 g per mole of said silver halide.

11. The direct positive silver halide photographic emulsion of claim 1, wherein the emulsion contains a hydroxytetrazaindene compound selected from the compounds represented by the following general formulae (IV) or (V)

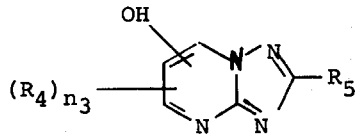

(IV)

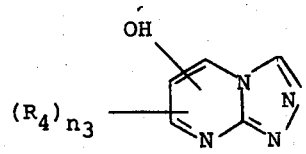

(V)

wherein $R_4$ and $R_5$ each represents a hydrogen atom, an alkyl group or an aryl group and $n_3$ is 1 or 2.

12. A direct positive silver halide photographic material comprising a support having coated thereon the direct positive silver halide photographic emulsion of claim 1.

13. The direct positive silver halide photographic emulsion of claim 6, wherein the compound containing a labile sulfur is present in an amount of about $10^{-8}$ to $10^{-2}$ moles per mole of the silver halide and the gold compound is used in an amount of about $10^{-8}$ to $10^{-3}$ moles per mole of the silver halide.

* * * * *